US009309035B2

(12) United States Patent
Futase et al.

(10) Patent No.: US 9,309,035 B2
(45) Date of Patent: Apr. 12, 2016

(54) SELF-STANDING LIQUID PACKAGE BAG WITH A FLAT FILM VALVE

(75) Inventors: Katsunori Futase, Niigata (JP); Yuma Shinoda, Niigata (JP)

(73) Assignee: YUSHIN CO., LTD., Niigata (JP)

( * ) Notice: Subject to any disclaimer, the term of this patent is extended or adjusted under 35 U.S.C. 154(b) by 469 days.

(21) Appl. No.: 13/380,685

(22) PCT Filed: Jun. 23, 2010

(86) PCT No.: PCT/JP2010/061081

§ 371 (c)(1),
(2), (4) Date: Dec. 23, 2011

(87) PCT Pub. No.: WO2010/150911

PCT Pub. Date: Dec. 29, 2010

(65) Prior Publication Data

US 2012/0114269 A1 May 10, 2012

(30) Foreign Application Priority Data

Jun. 25, 2009 (JP) ..... 2009-151116
Aug. 26, 2009 (JP) ..... 2009-195134

(51) Int. Cl.
*B65D 75/00* (2006.01)
*B65D 30/24* (2006.01)
*B65D 75/58* (2006.01)

(52) U.S. Cl.
CPC ..... *B65D 75/008* (2013.01); *B65D 31/14* (2013.01); *B65D 75/5811* (2013.01)

(58) Field of Classification Search
CPC .... B65D 31/14; B65D 35/46; B65D 47/2018; B65D 49/02
USPC ..... 383/43, 44, 47, 104, 906; 222/92, 107, 222/572, 494, 212, 213
See application file for complete search history.

(56) References Cited

U.S. PATENT DOCUMENTS 3,184,121 A 5/1965 Volckening
3,610,477 A * 10/1971 Herzig ..... 222/494

(Continued)

FOREIGN PATENT DOCUMENTS

EP 1 757 531 2/2007
EP 1 783 061 5/2007

(Continued)

OTHER PUBLICATIONS

JP06156512Translation.*

(Continued)

*Primary Examiner* — Jes F Pascua
*Assistant Examiner* — Nina Attel
(74) *Attorney, Agent, or Firm* — Greenblum & Bernstein, P.L.C.

(57) ABSTRACT

A self-standing liquid package bag provided with flat film valve is provided at a single use form by self-standing a liquid package bag with a film valve having a one-way function without being required to house and fix in another outer package vessel and obstructing the one-way function of the film valve. The self-standing liquid package bag of the invention is formed by protrudingly disposing a flat film valve having a one-way function, which is subjected to a wetting treatment at full inner faces in a pouring path and a portion adjacent to a fused part near to the pouring path, on an upper part or top part of at least one side edge of a bag body portion and disposing a self-standable bottom portion at bottom thereof.

6 Claims, 5 Drawing Sheets

(56) References Cited

U.S. PATENT DOCUMENTS

| | | | | |
|---|---|---|---|---|
| 5,134,875 | A * | 8/1992 | Jensen et al. | 73/1.03 |
| 5,857,592 | A | 1/1999 | Hyldgaard et al. | |
| 6,357,631 | B1 * | 3/2002 | Zaksenberg | 222/212 |
| 2008/0264970 | A1 | 10/2008 | Kasai | |
| 2010/0119783 | A1 | 5/2010 | Futase | |
| 2010/0209025 | A1 | 8/2010 | Futase | |

FOREIGN PATENT DOCUMENTS

| | | | | |
|---|---|---|---|---|
| EP | 1783061 | A1 * | 5/2007 | B65D 75/58 |
| GB | 769 810 | | 3/1957 | |
| JP | 4-053644 | | 5/1992 | |
| JP | 06-156512 | | 6/1994 | |
| JP | 06156512 | A * | 6/1994 | B65D 33/38 |
| JP | 08-508225 | | 9/1996 | |
| JP | 2000-072152 | | 3/2000 | |
| JP | 2000-504658 | | 4/2000 | |
| JP | 2000-203658 | | 7/2000 | |
| JP | 2002-362591 | | 12/2002 | |
| JP | 2004-515423 | | 5/2004 | |
| JP | 2004-196364 | | 7/2004 | |
| JP | 2004-352328 | | 12/2004 | |
| JP | 2004-352358 | | 12/2004 | |
| JP | 2005-015029 | | 1/2005 | |
| JP | 2005-059958 | | 3/2005 | |
| JP | 2007326581 | A * | 12/2007 | |
| JP | 2008-266346 | | 11/2008 | |
| JP | 2009-132410 | | 6/2009 | |
| WO | 97/29966 | | 8/1997 | |
| WO | 2009/069514 | | 6/2009 | |
| WO | 2010/004853 | | 1/2010 | |

OTHER PUBLICATIONS

Japan Office action, dated Mar. 26, 2013 along with an english translation thereof.

Japan Office action, mail date is Apr. 9, 2013, along with an English langusge translation.

International Preliminary Report on Patentability of PCT/JP2010/061081, dated Jan. 26, 2012.

Korea Office action, mail date is Aug. 31, 2013.

European search report for EP10792228.8 dated Jan. 29, 2014.

* cited by examiner

SELF-STANDING LIQUID PACKAGE BAG WITH A FLAT FILM VALVE

TECHNICAL FIELD

This invention relates to a self-standing liquid package bag with a flat film valve of self-sealing one-way function (one-way pouring nozzle for pouring liquid) constituted by combining two front and rear plastic films each having a high flatness and a lamination structure.

RELATED ART

As a liquid package bag provided with a liquid pouring nozzle made from a plastic film with a self-sealing one-way function or a film-shaped one-way pouring nozzle, there are ones previously proposed by the inventors and disclosed in JP-A-2005-15029, JP-A-2005-59958 and so on.

Since the liquid package bag with these one-way pouring nozzles are made from a soft laminate plastic film for causing the one-way action of the nozzle, there are used non-self standing and atypical soft package bags. Therefore, such liquid package bags take a shape that they cannot be used on a table or the like independently as they are.

As to such liquid package bags, therefore, there have hitherto been adopted a method of housing and fixing the bag in a vessel as disclosed in JP-A-2004-196364, and a method of housing the bag within an outer packing vessel with a dispenser function such as self-standing flexible package bag made from a soft laminate film or paper to impart self-standing property as disclosed in Japanese Patent Application No. 2008-266346.

SUMMARY OF THE INVENTION

Problems to be Solved by the Invention

In the housing means disclosed in JP-A-2004-196364, however, it is necessary that the non-self standing flexible package bag is housed in a paper box body and fixed thereto, so that there are problems that the production steps including the box packing become cumbersome and higher in the cost. On the other hand, in the housing means disclosed in Japanese Patent Application No. 2008-266346, the support form can be stabilized simply by fixing upper and lower parts of a non-self standing package bag to the outer packing vessel with the dispenser function and also the product cost can be suppressed. In this method, however, there is an operation that the outer packing vessel is manufactured at a separate step and thereafter the non-self standing package bag is housed in this vessel and fixed thereto, so that further simplification of the product and suppression of production cost are demanded.

In these conventional techniques, there is a fundamental problem that a self-standing vessel should be separately provided in addition to the non-self standing flexible package bag. It is a cause that the main body of the package bag must be made from a laminate plastic film of a soft material so as not to obstruct the self-sealing one-way function inherent to the flat film valve. Therefore, the way of thinking for role allotment between the conventional non-self standing package bag and the self-standing vessel supporting it has to be re-thought in view of the cost and productivity.

Also, it was common that the bag body and the film valve in the liquid package bag with the flat film valve have been manufactured from the same soft and thin laminate plastic film so as not to obstruct the self-sealing one-way function of the flat film valve. Because, such a plastic film is an important factor for giving the one-way function to the flat film valve by causing collapse deformation of the bag body due to the pouring of the liquid packed material to generate negative pressure. Therefore, the laminate plastic film for the bag body should be thinned, which is a fundamental reason that the self-standing property cannot be imparted to the bag body.

When the liquid package bag with the flat film valve is manufactured from such a soft and thin laminate plastic film, the adhesiveness between the mutually two front and rear laminate plastic films can be improved, whereas the liquid packed material to be poured from the interior of the bag body cannot be poured in a constant direction smoothly and stably due to the lowering of the directionality of the film valve itself (pouring directionality) and further bending easiness, and strain is generated between the two mutually piled front and rear laminate plastic films associated therewith to lose the flatness and always interpose the liquid material therebetween, and hence a gap for causing the one-way action cannot be maintained, which is a fear of obstructing the one-way function.

In the conventional liquid package bag, the flat film valve and the bag body are formed separately, so that a step for fusion-joining the both to each other is required. In the fusion-joined portion, it is particularly required to enhance the joining strength by repeating heat-sealing or the like at an end position of the film-shaped one-way valve for preventing leakage of the packed material or the like due to peeling or poor sealing. Otherwise, there is also a fear of breaking the bag.

The flat film valve has mainly a two or three layer structure comprised of a base film layer and a sealant layer laminated on at least one surface thereof, wherein the base film layer and the sealant layer are laminated through an adhesive layer, an anchor coating layer or the like.

When the film valve and the bag body are formed separately as mentioned above, the adhesive layer or anchor coating layer is exposed to the inside of the bag body at the base end side of the film valve (fusion-joined portion to the bag body), which may be contacted with the packed material in the bag. From a viewpoint of safeness and health, therefore, it is necessary to conduct a treatment that the base end sides of the film valve are heated and pressed with a heat-sealing means at a state of sandwiching from up and down to cover end faces of the base end sides with respective sealant layers laminated so as to sandwich the base film layer by the method disclosed in JP-A-2009-132410, which has a problem that the production steps become complicated and the cost becomes higher.

It is, therefore, a primary object of the invention to solve the aforementioned problems inherent to the conventional techniques, i.e. problems in the package structure comprised of the non-self standing package bag and the self-standing vessel having different role allotments.

It is a concrete object of the invention to propose a self-standing liquid package bag provided with a flat film valve wherein a liquid package bag with a flat film valve having a one-way function is not housed and held in a separate self-standing outer packaging vessel and the package bag itself can be self-stood without obstructing the one-way function of the film valve and the package bag takes a use form at a self-standing posture by itself.

It is another object of the invention to propose a self-standing liquid package bag with a flat film valve wherein a film valve portion and a bag body portion are integrally formed by a single laminate film at each of their front and rear sides to thereby simplify the production steps and realize the low cost and also the stability of the pouring direction of the packing material (directionality) is excellent even when the film-shaped one-way valve and the bag body portion are formed integrally.

Means for Solving Problems

The inventors have made various studies for achieving the above objects and developed an invention having the following constructions.

That is, the invention proposes a self-standing liquid package bag provided with a flat film valve, characterized in that in an upper part or a top part of either side edge of a bag body portion having an elasticity and made from two front and rear laminate plastic films, each of which being constituted with an oriented base film layer and a sealant layer laminated on at least one surface of the base film layer, is protrudingly formed a flat film valve having a self-sealing one-way function by fusing the opposed inner sealant layers of the two laminate plastic films to each other at peripheral parts other than base end sides to form a fusion portion and a non-fusion portion as a pouring path of a liquid packed material and subjecting full faces in the pouring path and only a part of the fusion portion adjacent to the pouring path to a wetting treatment, and a self-standing bottom portion is formed at the bottom of the bag body portion.

In the self-standing liquid package bag with the flat film valve according to the invention are preferable the following means:

(1) when the liquid packed material is poured by tilting the bag body portion, the flat film valve develops a one-way function that inner surfaces of the laminate plastic films are closely adhered to each other at a wetted state of retaining the liquid packed material in the pouring path by generating negative pressure inside the bag body portion, and at the same time the invasion of ambient air is automatically prevented instead of the poured liquid packed material;

(2) each of the bag body portion and the flat film valve is constituted with a thick laminate plastic film having an elasticity and a thickness of base film layer of 50-250 μm and a thickness of sealant layer of 10-60 μm;

(3) a thick film and a thin film having different thicknesses are used in the front and rear laminate plastic films constituting each of the bag body portion and the flat film valve;

(4) a high-nerve film and a low-nerve film having different nerves are used in the front and rear laminate plastic films constituting each of the bag body portion and the flat film valve;

(5) the thick film in the laminate plastic film has a thickness of not less than 60 μm but not more than 250 μm and the thin film has a thickness of not less than 10 μm but less than 60 μm;

(6) the high-nerve film in the laminate plastic film has a nerve of not less than 40 mN but not more than 600 mN, and the low-nerve film has a nerve of not less than 10 mN but less than 40 mN;

(7) the wetting treatment subjected to the inner surface of the pouring path in the flat film valve is conducted in the thick or high-nerve film of the laminate plastic film;

(8) the wetting treatment subjected to the inner surface of the pouring path in the flat film valve is conducted in the thin or low-nerve film of the laminate plastic film;

(9) the bag body portion is a three-side sealed self-standing bag other than the self-standing bottom portion made of the soft laminate plastic film, and its standing posture is flat in an upper part and cylindrical in a lower part;

(10) the flat film valve is provided with a coating layer of a water-repellant material or an oil-repellant material in a neighborhood including a predetermined opening position disposed in at least tip part of its outer surface; and

(11) the flat film valve is provided at a position of its lower end part located from a predetermined opening portion toward the base end side with a steepled protrusion for prevention of liquid dripping.

The self-standing liquid package bag according to the invention having the above construction can be applied in use at a self-standing state by itself without housing in and fixing to a separate outer packaging vessel or the like. Therefore, the production cost of the liquid package bag having a one-way function can be reduced.

In the invention, a factor for deteriorating a quality of a liquid packed material filled by liquid-in-seal filling of the like (only the liquid packed material is fundamentally filled at a gasless state) such as oxidation or the like can be removed by the self-sealing one-way function of the flat film valve or the self-standing liquid package bag with the flat film valve.

According to the invention, since the inner face of the pouring path in the flat film valve and the portion of the outer peripheral fusion part of the flat film valve near to the pouring path are subjected to the wetting treatment, even after the flat film valve is opened by cutting out at a given position (opening of the package bag), flowing of air or the like backward into the bag (air is flown into the package bag instead of the pouring of the liquid packed material) can be prevented surely, and hence the liquid packed material retaining in the bag can be held at a fresh state over a long period of time. Further, the thick and high-nerve laminate plastic film capable of self-standing the package bag itself can be used by this wetting treatment. Even in the latter case, there is caused no deterioration of the self-sealing one-way function of the flat film valve.

In the invention, the self-standing liquid package bag is formed by superposing the two laminate plastic films with different thickness and/or nerve one upon the other. In this case, the large thickness or high nerve laminate film (hereinafter referred to as thick film or high-nerve film) can develop a function as a core material to improve the stability in the pouring (discharging) direction of the liquid material (directionality) without bending or twisting the film-shaped one-way valve portion. Further, the small thickness or low nerve laminate film (hereinafter referred to as thin film or low-nerve film) is closely adhered so as to well attach to the thick or high nerve film, so that the flattening property (flatness) between the mutual laminate plastic films and the one-way function can be more improved.

According to the invention, the bag body portion is a self-standing bag sealed in three way other than the self-standing bottom portion, so that the standing posture can maintain the flat form at its upper part even after the liquid packed material is filled in the bag through liquid-in-seal filling or the like, and hence the one-way function of the flat film valve can be developed effectively.

According to the invention, at least a predetermined opening position (pouring port) of the flat film valve is excellent in the water-repellency and oil-repellency, so that the dripping of the liquid packed material after the pouring can be prevented effectively. Therefore, there is no soiling of user's hand and fingers, and also even if the liquid dripping is caused, the liquid falls down along the steepled protrusion disposed in the lower end part of the flat film valve, so that the liquid dripping fallen down from the lower end part of the flat film valve to the bag body portion can be prevented more effectively.

EMBODIMENTS FOR CARRYING OUT THE INVENTION

Figure 1:
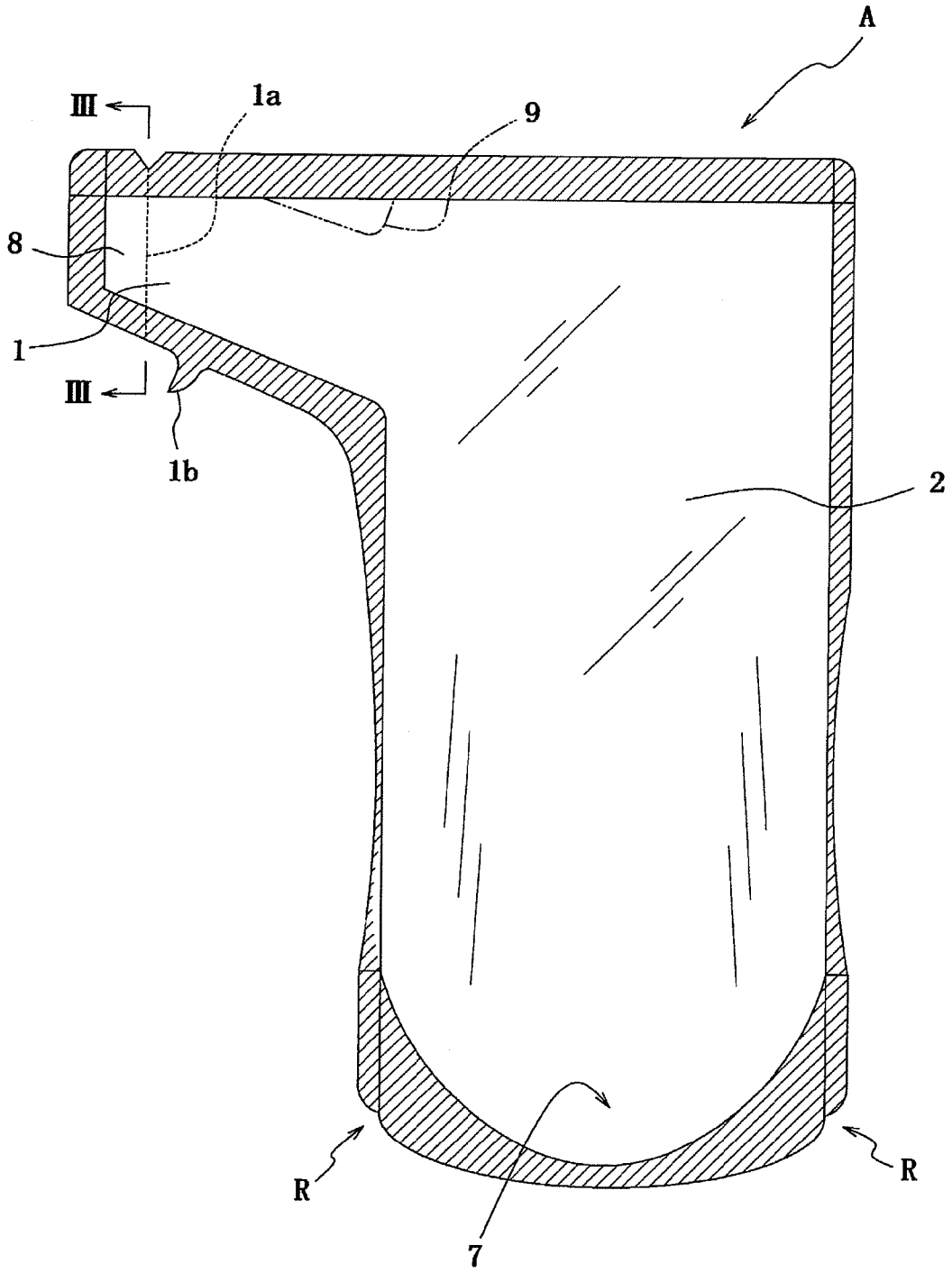
FIG. 1 is a front view illustrating an embodiment of the self-standing liquid package bag according to the invention.

The self-standing liquid package bag according to the invention is a self-standing type liquid package bag (standing pouch) capable of self-standing by integrally and protrudingly forming a flat film valve having a self-sealing one-way function with a bag body portion of a package bag, for example, made from an elastic and thick laminate plastic film of two- or three-layer structure at an upper part or a top part of at least one side end of the bag body and forming a self-standing bottom portion of a ship's bottom form at the bottom thereof.

In the self-standing liquid package bag, it is important to protrude the flat film valve from the bag body portion for imparting the self-sealing one-way function.

Moreover, the one-way function of the flat film valve means that the pouring path formed between the two front and rear flat closable laminate plastic films by superposing them to each other is closed due to steady interposition of the liquid material through capillary action to develop the self-sealing one-way function. For this end, the two front and rear laminate plastic films provide a higher one-way effect as the flattening property (flatness) becomes high. Therefore, a gap between the two front and rear laminate plastic film in the piling is about 2 μm-300 μm, preferably about 2 μm-30 μm.

The self-standing liquid package bag according to the invention can be manufactured, for example, by the following method.

At first, a pair of two superposed (front and rear faced) laminate plastic films, e.g. sealant layer films each made of polyethylene or the like are integrally united with each other so as to leave a portion communicating with a main body portion of a bag by fusing their peripheral edge part through, for example, heat sealing, high frequency sealing, impulse sealing or the like by means of a common bag-making machine in form of protruding a flat film valve from the bag body portion.

Then, a liquid material to be packed is filled from a non-sealed part of the bag body portion by liquid-in-seal filling or by degassing from an interior of the bag after the filling of the liquid material to be packed at a gasless state of sufficiently removing the gas from the interior of the bag body portion. Moreover, a bottom portion of a ship's bottom form is fused to a lower part of the bag body through heat sealing or the like prior to the liquid-in-seal filling. In this way is obtained a self-standing liquid package bag provided with a flat film valve, which has a self-standing one-way function liquid-tightly filled with the liquid material to be packed.

The term "liquid-in-seal filling" used herein means that the films are heat-sealed together at a state of sandwiching the liquid filled in the bag between the films while removing a portion of the liquid in order not to retain a gas such as air, nitrogen or the like in the interior of the package bag.

Moreover, the bag body portion is preferable to be a three-side sealed self-standing bag other than the self-standing bottom portion because the upper part of the bag in the standing posture can be maintained at a flat planular form by subjecting left and right side edges of the bag body portion to longitudinal sealing after the liquid material to be packed is filled in the bag body portion at a gasless state through liquid-in-seal filling. As a result, the two front and rear laminate plastic films constituting the flat film valve are high in the flattening property (flatness), which is effective for guaranteeing the one-way function of the flay film valve and surely maintaining the one-way function after the pouring of the liquid packed material.

The reason why the liquid material to be packed is filled through liquid-in-seal filling (gasless filling) as mentioned above is due to the fact that it is necessary to seal the liquid packed material in the bag at a degassing-sealed state for sufficiently developing the self-sealing one-way function of the flat film valve. This is preferable in view of preventing oxidation or the like of the liquid material to be packed such as soy sauce, ponzu sauce, viscous mayonnaise, alcoholic beverage and others.

The pouring of the liquid packed material filled in the self-standing liquid package bag according to the invention is carried out by cutting out a predetermined opening portion formed near to the tip part of the flat film valve (tip side located apart from a position of forming a tear-inducing flaw or a notch) through fingers. That is, the required pouring of the liquid packed material is carried out by tilting the main body of the package bag after the opening of the flat film valve so as to take a posture of directing the opened portion of the flat film valve (pouring port) downward.

When the main body of the package bag is tilted, the pouring path of the flat film valve made of soft laminate plastic films forms a position of allowing the pouring of the liquid packed material by flowing the liquid material through an action of hydraulic head pressure of the liquid packed material and further through pressurization of a shank of the bag body portion with fingers to separate the front and rear films from each other against intermolecular force among film-liquid-film so as to form a gap for opening the pouring path.

When the liquid packed material is poured through the opening portion (pouring port) of the flat film valve, the bag body portion made from the soft laminate plastic film do not conduct the absorption of ambient air through the self-sealing one-way function of the film valve (no penetration of air into the bag body instead of the poured liquid material) irrespectively of the pouring of the liquid packed material, so that the bag body portion is gradually subjected to contraction or collapse deformation only by a quantity corresponding to the poured volume fraction.

The pouring of the liquid packed material from the opening portion of the flat film valve is stopped by returning the liquid package bag to the original standing posture. By the stop of the pouring, the liquid packed material filled in the bag body portion is always interposed among the inside of the pouring path of the flat film valve and the non-liquid part inside the bag body portion through capillary action to form a wetted state, so that inner faces of the plastic films in the flat film valve are strongly closed to each other at the time of the stop, and the opening portion disposed in the tip part of the flat film valve is also closed, whereby the penetration of ambient air into the main body of the package bag can be prevented surely.

In such a self-standing liquid package bag with the flat film valve, the liquid packed material filled in the bag is shielded from ambient air before, during and after the pouring, so that the oxidation, contamination and the like of the liquid packed material in the bag are prevented effectively.

As seen from the above explanation, the liquid material is always interposed between the inner faces of the two laminate plastic films constituting the flat film valve (pouring path) through capillary action as long as the liquid material is retained in the bag. That is, the one-way action by closing the films to each other is automatically conducted by returning the self-standing liquid package bag to the standing state to release the flat film valve from the hydraulic head pressure and return it to the original production form and further by attracting the inner faces of the pair of front and rear laminate plastic films (pouring path) to each other at a state of wetting with the liquid packed material under a reduced pressure when a part of the liquid packed material in the flat film valve is flown back to the bag body portion. Such a closing is more ensured when the bag body portion subjected to contraction or collapse deformation associated with the pouring of the liquid packed material from the package bag acts to reduce the pressure in the interior thereof based on elastic restoring force inherent thereto.

Thus, the flat film valve develops the excellent self-sealing one-way function by returning of self-standing liquid package bag to the standing state and automatic close-sealing of the tear-opened pouring port (self-sealing) without special operation or the like.

On the other hand, the re-pouring of the liquid packed material is conducted more effectively by tilting the self-standing package bag according to the invention as mentioned above, and preferably further pressurizing the shank of the bag body portion, while the stop of the pouring can be also conducted by returning the package bag to the standing state as mentioned above.

Even in this case, the flat film valve can develop the excellent one-way function against the penetration of ambient air based on the automatic close-sealing.

In the self-standing liquid package bag according to the invention, it is characterized that the package bag itself is provided with the self-standing property by using a nerve and thick laminate plastic film as compared with the conventional non-self standing liquid package bag made from soft and thin laminate plastic films and disposing a self-standing bottom portion in the lower end part of the bag body and can be used alone as it is.

Moreover, the one-way function of the flat film valve is developed by closely attracting the inner faces of the flat film valve to each other under a reduced pressure generated due to the contraction or collapse deformation associated with the pouring of the packed material as mentioned above. Therefore, when the bag body portion and the flat film valve are formed by using a self-standable thick and nerve laminate plastic film as described in the liquid package bag according to the invention, there is a fear that the contraction of the bag body portion and the closing between the inner faces in the flat film valve are obstructed to deteriorate the one-way function.

In the invention, therefore, in order that the intermolecular force acting between the mutual films for generating the above one-way function more ensures the closing force resulting from the narrowing through the inclusion of the liquid material to thereby strengthen the one-way function of the flat film valve (closing force between the mutual laminate plastic films), inner faces in the pouring path of the flat film valve, preferably inner faces in at least an upper part of the bag body portion are subjected to a wetting treatment.

For example, the inner faces made of the sealant layers in the pouring path of the flat film valve are subjected to the wetting treatment as described below, whereby the closing force resulting from the intermolecular force generated by always including the liquid packed material in the inner faces of the pouring path through capillary action can be generated between the two front and read piled laminate plastic films constituting the flat film valve to more surely develop the aforementioned self-sealing one-way function.

The wetting treatment is a treatment that the surface of the sealant film in the laminate plastic film, for example, made from PE, PP, EVA, ionomer or the like is subjected to corona discharge treatment, UV ozone treatment, plasma treatment, flame treatment or the like to improve the wetting property of the film through synergistic effect of physical surface modification and chemical surface modification due to the formation of polar functional group in the film surface. The film surface subjected to such a treatment is called as wet-treated surface.

The inventors have tested the action and effect of this wetting treatment. The results are shown in Table 1. That is, a wet tension of an inner face film is measured with a wetting reagent after inner faces (inner face of sealant film) of a pouring path of a flat film valve in a liquid package bag with E20 three-layer lamination structure are subjected to corona discharge treatment (discharging condition: discharge quantity of 81.7 W·min/m$^2$).

As a result, the wet tension before the wetting treatment is 32 N/m, while it is 56 N/m after the wetting treatment. Also, contact angles with respect to water, soy sauce, ponzu sauce and oil are shown in Table 1, from which coagulation power of the liquid, i.e. surface tension (S) is made weak and all contact angles (θ) are apparently made small to improve the wetting property. Thus, the liquid to be required can be always existent between the mutual films without interruption in addition to the above capillary action, so that the pouring path is wetted without drying even if the liquid package bag is not used over a long period of time, and hence the effectiveness of this treatment is confirmed in view of surely imparting the one-way function.

TABLE 1

| Corona discharge | Contact angle (θ) | | | |
|---|---|---|---|---|
| treatment | water | soy sauce | ponzu sauce | oil |
| absence | 98 | 83 | 86 | 39 |
| presence | 73 | 66 | 67 | 19 |

*θ: average of three measured values
discharge electrode length L: 0.108 m
film speed: 9.6 m/min
discharge power: 85 W Particularly, the invention is characterized by subjecting not only the inner face of the pouring path of the flat film valve but also a part of a fusion portion formed in the outer peripheral edge of the flat film valve near to the pouring path (boundary between the fusion portion on the outer periphery of the flat film valve and the pouring path: about 0.5-3 mm) to the wetting treatment. Because, the side edge of the pouring path, i.e. the boundary part between the pouring path and the fusion portion on the outer periphery of the film valve is a weak part of the closing force resulted from the intermolecular force of the liquid packed material, and there is a fear that although the wetting treatment is previously applied to the laminate plastic film before the formation of the flat film valve in correspondence with the form of the pouring path, it is difficult to accurately superpose the films one upon the other when the flat film valve is formed by superposing the laminate plastic films one upon the other and fusing their outer peripheral parts and hence a part not subjected to the wetting treatment is caused in the vicinity of the boundary part and also there is a fear that air is flown backward into the package bag through such a part as a path.

That is, the improvement of surface tension on the boundary part is more effective for developing the self-sealing one-way function of the flat film valve, and particularly it acts effectively when the liquid packed material is a low-wetting material such as water.

Moreover, the film construction of the self-standing liquid package bag according to the invention is comprised of a laminate plastic film comprising, for example, a uniaxially- or biaxially-oriented base film layer and a sealant layer(s). Even when the laminate plastic film has a two-layer or three-layer structure, the each sealant layer can be laminated on the base film layer by melt extrusion laminate process, dry laminate process, extrusion laminate process, co-extrusion laminate process or the like.

In the formation of the liquid package bag according to the invention, it is preferable to use a raw material (film) having a self-standing property. The base film is preferable to be constituted with a polyethylene terephthalate, polyester, EVOH, nylon resin, polypropylene, polyethylene film or the like having a thickness of 50-250 μm, preferably 80-180 μm, while the sealant layer is preferable to be constituted with a polyethylene, polypropylene, ethylene-vinyl acetate copolymer, ethylene-ethyl acrylate copolymer, ionomer layer or the like having a thickness of 10-60 μM, preferably 10-30

When the thickness of the base film layer is less than 50 μm, there is a fear that the steam impermeability, gas barrier property and so on are lacking, while when it exceeds 250 μm, the bending strength of the laminate plastic film becomes too large, and there is a fear that the closing property between the inner faces of the flat film valve is lost after the stop of the pouring of the liquid packed material.

When the thickness of the sealant layer is less than 10 μm, there is a fear of ensuring the sufficient sealing strength, while when it exceeds 60 μm, there is a fear that the bending strength of the laminate plastic film becomes too large. Moreover, the sealant layer may be two or more layers as long as the thickness in total is within the above range.

Moreover, it is preferable to use the base film layer by forming a gas barrier layer such as $SiO_2$ deposited layer, vinylidene chloride coating layer, aluminum oxide coating layer, Al deposited layer or a sputtering layer thereof on either one-side surface of the base film layer. Thus, the steam impermeability, gas barrier property and the like are imparted to the base film layer, so that it is possible to store the liquid packed material over a long period of time without deterioration. Moreover, the thickness of the gas barrier layer is desirable to be about 0.5 μm-20 μm.

Also, the laminate plastic film used in the liquid package bag of the invention is required to have a strong nerve because the liquid material is filled in a constant volume. In the invention, the bending strength per unit width (15 mm) of the laminate plastic film, i.e. nerve is preferable to be about 40-300 mN as measured by using a nerve measuring device as disclosed in FIG. 10 of JP-A-2005-59958. When the nerve of the laminate plastic film is less than 40 mN, the stability of the pouring direction and the like are poor in the pouring of the liquid packed material from the package bag and also nerve feeling is weak and hence there is a fear of actualizing the lacking of the strength in the package bag itself, while when the nerve of the laminate plastic film exceeds 300 mN, there is a fear of lowering the one-way function as a whole inclusive of the flat film valve irrespectively of the lamination structure of the laminate plastic film.

Further, in order to effectively develop the stability of the pouring direction (directionality) and the outer one-way function of the flat film valve in the self-standing liquid package bag, thick film/high-nerve film and thin film/low-nerve film being different in at least one of thickness and nerve may be used as each of the front and rear laminate films and superposed with each other to form the liquid package bag.

Thus, when the self-standing liquid package bag is formed by superposing the laminate films having at least different thickness and/or nerve, the thick film/high-nerve film having a large thickness or a high nerve fulfils a function as a core material, which can improve the stability of the pouring direction (directionality) of the liquid packed material without bending or twisting the film valve portion. Furthermore, the thin film/low-nerve film in the thus superposed laminate plastic films is well closed to the thick film/high-nerve film, so that the flattening property (flatness) as a valve body can be easily improved to effectively develop the one-way function of the flat film valve.

In this case, the thickness of one of the laminate plastic films (thick film) is made thicker than the thickness of the other laminate plastic film (thin film). For example, the thickness of the thick film is not less than 60 μm but not more than 250 μm, preferably 80-150 μm, while the thickness of the thin film is not less than 10 μm but less than 60 μm, preferably 20-40 μm.

As the two front and rear laminate plastic films, the nerve of one of the laminate plastic films (high-nerve film) is made higher than the nerve of the other laminate plastic film (low-nerve film). It is preferable that the high-nerve film has a nerve of not less than 40 mN but not more than 600 mN and the low-nerve film has a nerve of not less than 10 mN but less than 40 mN.

The thickness or nerve of the laminate plastic film differs depending on the lamination structure of the film, material of the base film layer and sealant layer, and the like. However, when the thickness and/or the nerve of the laminate plastic film fall below the above range in case of the thick film/high-nerve film (thickness: less than 60 μm, nerve: less than 40 mN) or exceeds the above range in case of the thin film/low-nerve film (thickness: more than 60 μm, nerve: more than 40 mN), the thick film/high-nerve film can not function as the core material after the pouring of the liquid packed material when the thick film/high-nerve film is closed to the thin film/low-nerve film by a closing force based on the intermolecular force of the liquid packed material always existing between the laminate plastic films, and hence the pouring directionality is deteriorated.

As to the thick film/high-nerve film, when the thickness or nerve of the laminate film exceeds the above range (thickness: more than 250 μm, nerve: more than 600 mN), the bending strength becomes too large, and the closing property between inner faces in the film-shaped one-way valve portion is damaged after the pouring stop of the liquid packed material and the one-way function may be not developed effectively. As to the thin film/low-nerve film, when the thickness or nerve of the laminate film falls below the above range (thickness: less than 10 μm, nerve: less than 10 mN), the sufficient strength may not be ensured.

In general, the film having a high nerve is a thick film having a large thickness, while a film having a low nerve is frequently a thin film having a small thickness. In any case, a middle layer such as a gas barrier layer or the like may be properly interposed between the base film layer located toward the outer surface and the sealant layer located toward the inner surface as previously mentioned.

In the flat film valve as a most feature of the invention, a length of an opening portion or pouring edge portion of the flat film valve extending substantially in the widthwise direction (vertical direction) of the laminate plastic film is preferable to be about 5-80 mm irrespectively of the lamination number in the laminate plastic film. The term "substantially the widthwise direction" used herein considers a case that the tearing direction of the flat film valve and hence the elongating direction of the opening edge portion thereof may be tilted at an angle of 0-15° with respect to the widthwise direction of the laminate plastic film. When the length of the opening portion of the flat film valve is less than 5 mm, the pouring quantity is too small in association with the volume of the main body of the package bag, while when it exceeds 80 mm, it is difficult to specify the pouring direction accurately.

In the self-standing liquid package bag according to the invention, it is preferable that a coating layer of a water-repellant material or an oil-repellant material is formed on the outer surface of at least opening portion of the flat film valve or the outer surface of its neighborhood including the predetermined opening portion. By applying such a treatment to the flat film valve, so-called liquid-cutting property is enhanced when the pouring of the liquid packed material is stopped by returning the package bag to the self-standing posture and accidental dropping of the liquid packed material can be prevented effectively.

As the water repellant material is used a water-repellant coating agent made from silicone oil, fluorine-based resin, acrylic resin or amide resin. As the oil repellant material is used an oil-repellant coating agent made from silicon resin, teflon resin, silicon-modified acrylic resin or the like. To these materials may be added a urethane resin, acrylic resin, ester resin, pyroxylin resin, amide resin, vinyl chloride resin, rubbery resin, styrene resin, olefinic resin, vinyl hydrochloride resin, cellulose resin, phenolic resin or the like as a binder.

In the invention, the reason when the water repellant/oil repellant coating layer is formed is to prevent phenomenon due to the fact that when the liquid packed material is low-viscosity ones such as soy sauce, alcohol at the like, as the liquid packed material is poured by tilting the package bag having frequently a rectangular form as a plane form after the formation of the pouring port by inches for preventing the liquid packed material from over-pouring to the foods, it frequently falls dropwise in unintended places along a side part lower than a height level of the resulting pouring port or located at a lower side thereof under the tilted posture of the package bag and the clothing is sometimes soiled by the liquid packed material.

Even if the liquid packed material is high-viscosity ones such as dressing oil, salad oil and the like, since the oil-repellant layer is disposed on the outer surface of the side part located at the lower side of the pouring port opened near to the tip part of the flat film valve at the pouring posture, when the liquid packed material is gradually poured from the pouring port by tilting the package bag by inches, the liquid cutting property is improved to prevent wetting of the side part located at the lower side of the package bag with oil or the like at once, whereby the fear of falling down the viscous liquid to the unintended places can be removed effectively.

In the invention, it is preferable that the contact angle of the water-repellant/oil-repellant layer with the liquid packed material such as soy sauce or oil is a range of 100-170°. Thus, the dripping of the liquid packed material around the part near to the pouring port can be prevented sufficiently to more enhance the pouring accuracy.

The inventors have examined the influence of the water-repellant layer upon the liquid cutting property of the liquid packed material in the self-standing liquid package bag according to the invention. That is, there are provided a self-standing liquid package bag having no water-repellant layer (Comparative Example) and a self-standing liquid package bag having a water-repellant layer (Invention Acceptable Example) by applying silicone oil as a coating agent to a lower edge part ranging from a predetermined opening portion (predetermined pouring port portion) toward the bag body portion in a flat film valve having a lamination structure comprised of a biaxially-oriented nylon base film of 15 μm in thickness and a linear low density polyethylene sealant layer of 50 μm in thickness. Then, each of the two liquid package bags is filled with a concentrated soy sauce as a liquid packed material and fixed to a device for the measurement of tilting angle at a state of opening the pouring port, and thereafter the bag is gradually tilted at 50 mm/min to measure an angle (α) of starting the pouring of the liquid packed material.

From the results of Table 2, it can be confirmed that although the pouring start angle is not influenced by the presence or absence of the water-repellant layer, the liquid dripping is caused at the pouring start angle of the liquid packed material in Comparative Example, whereas in Invention Acceptable Example the liquid dripping can be suppressed up to a state of making the tilting angle stronger (smaller) that the pouring start angle of the liquid packed material.

TABLE 2

| | Invention Acceptable Example | Comparative Example |
|---|---|---|
| Water-repellant layer | presence (silicone oil) | absence |
| Pouring start angle | 71° | 69° |
| Angle of causing liquid dripping | 55° | 69° |

In the liquid package bag according to the invention, it is further preferable that a steepled protrusion for prevention of liquid dripping is disposed at a position of the lower edge part of the flat film valve located from its predetermined opening portion (pouring port) toward the base end side. The protrusion for prevention of liquid dripping can remove the fear of falling the liquid dripping to the unintended places without soiling the bag body portion because the liquid dripping caused in the pouring port of the flat film valve falls down along the protrusion before the arrival in the side part located at the lower side of the package bag. Moreover, it is preferable to form the water-repellant layer or oil-repellant layer on the outer surface of the steepled protrusion for the prevention of liquid dripping, whereby the wetting of the protrusion through the liquid dripping can be prevented at once.

In the invention, it is also preferable to dispose a protrusion as a damming portion of the purpose of rectifying the pouring stream (formation by sealing) on the sealed part of the upper edge in the pouring path of the flat film valve. The damming protrusion is made possible to stably pour the constant volume of the liquid packed material.

In the flexible package bag according to the invention, it is desirable to cope with the case of repeating the pouring plural times. Particularly, even in the case of re-pouring, it allows to smoothly pour a controlled given volume likewise the first pouring.

Then, a concrete form of the self-standing liquid package bag according to the invention will be described with reference to the drawings.

A self-standing liquid package bag A according to the invention shown in FIG. 1 is a case that a flat film valve 1 is protruded from an upper part in a left-side edge of a bag body portion 2, wherein the film valve 1 and the bag body portion 2 are formed from the same laminate plastic films.

Figure 2:
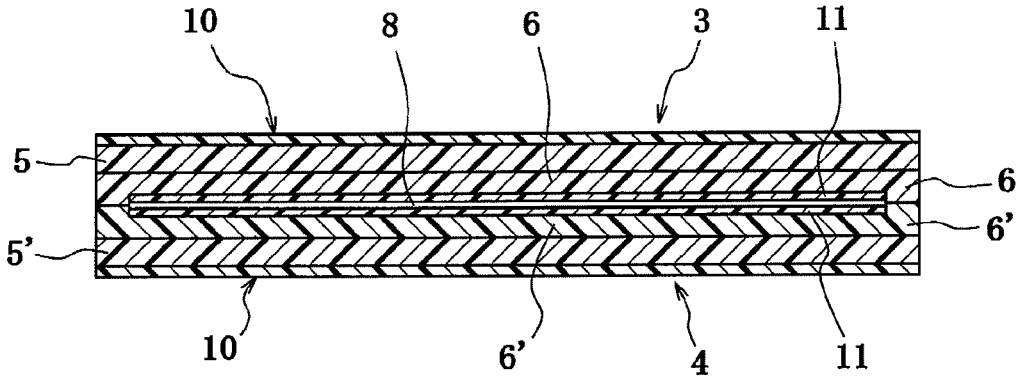
FIG. 2 is an enlarged cross sectional view of an embodiment of the self-standing liquid package bag according to the invention at a predetermined opening position of a flat film valve.

The film construction of the self-standing liquid package bag A is shown in FIG. 2 as shown by an enlarged section view taken along a line of FIG. 1 in a widthwise direction of the film valve that each of front and rear laminate plastic films 3, 4 to be fused mutually has a two-layer structure comprised of a base film layer 5, 5' and a sealant layer 6, 6' laminated on the base film layer 5, 5'. The inner sealant layers 6, 6' opposing to each other are fusion-joined to each other in each side part other than a top part for filling a liquid packing material at a given width, preferably through heat sealing as shown by a shaded area in FIG. 1 to thereby integrally unite the flat film valve 1 with the bag body portion 2, and thereafter a bottom portion 7 made from another film is fusion-joined to a lower end part (bottom) of the self-standing liquid package bag A through heat sealing or the like.

Moreover, the film construction of the liquid package bag A may be a three-layer structure formed by disposing sealant layers on both surfaces of the base film layer 5, 5'. The base film layer 5, 5' is, for example, a biaxially-oriented PET layer, NY layer or the like with a thickness of about 150 μm, while the sealant layer 6, 6' is, for example, a non-oriented thermoplastic resin layer such as PE layer, PP layer or the like with a thickness of about 25 μm.

In the self-standing liquid package bag A according to the invention, a liquid packing material is gas-less filled from the unsealed top part of the bag body portion 2 through liquid-in-seal filling or the like and at the same time the top part is fusion-joined through heat sealing or the like to thereby form a self-standing type liquid package bag A (standing pouch) liquid-tightly filled with the liquid packed material and having a ship's bottom portion.

Figure 3:
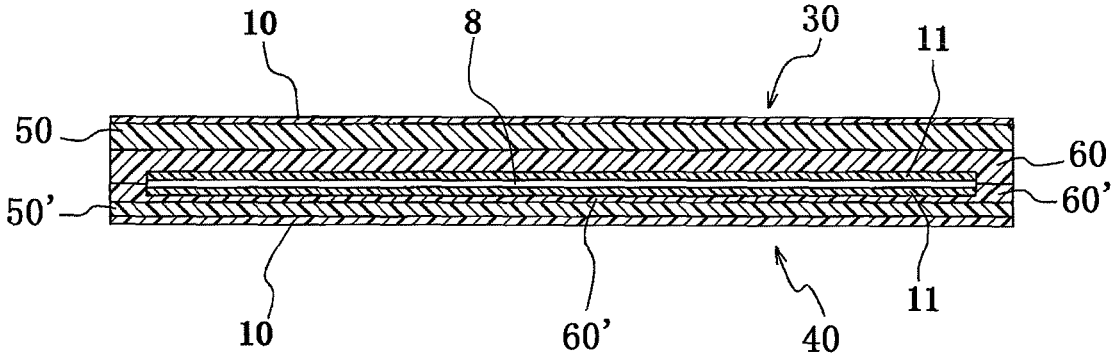
FIG. 3 is an enlarged cross sectional view of another embodiment of the self-standing liquid package bag according to the invention at a predetermined opening position of a flat film valve.

As the laminate plastic film constituting the self-standing liquid package bag A according to the invention, in addition to the film construction shown in FIG. 2, there may be a construction of FIG. 3 that each of the front and rear laminate plastic films to be fused mutually as shown by an enlarged section view in a widthwise direction of the film valve taken along a line of FIG. 1 is a combination of a thick film 30 having a large thickness and a thin film 40 having a small thickness. In the latter case, the thin film 40 is comprised, for example, of a base film layer 50' made from a biaxially-oriented PET layer or NY layer of about 12 μm and a non-oriented PE layer or PP layer 60' of about 10-15 μm laminated on the inner face of the base film layer 50', whereas the thick film 30 is comprised, for example, of a base film layer 50 made from a biaxially-oriented PET layer or NY layer of about 100 μm and a non-oriented PE layer or PP layer 60 of about 20-30 μm laminated on the inner face of the base film layer 50.

When the flexible package bag A is formed by superposing the thick film 30 and thin film 40 having different thicknesses, the thick film 30 in the flat film valve 1 particularly forms a core material In the flat film valve 1, and the stability of the pouring direction (directionality) is improved without bending or twisting, while the thin film 40 is closely adhered to the thick film 30, whereby the one-way function can be improved. Also, the wetting treatment is applied to at least one of the thick film and the thin film.

Moreover, the thick film 30 and the thin film 40 may be a film having a high nerve (high-nerve film) and a film having a low nerve (low-nerve film) in addition to the films having different thicknesses as mentioned above. The nerve of the laminate film is not dependent upon only the thickness of the laminate film, but is dependent upon the kind and lamination structure of the film. For example, a laminate film having a low nerve is existent even if the thickness is large, or a laminate film having a high nerve is existent even if the thickness is small. Moreover, the wetting treatment is applied to at least one of the high-nerve film having a high nerve and the low-nerve film having a low nerve.

The self-standing liquid package bag A according to the invention formed by using the laminate plastic films shown in FIG. 2 or FIG. 3 is preferable to be a self-standing bag formed by fusion-joining three sides of the bag body portion 2 other than a bottom portion 7 thereof through heat sealing or the like as shown in FIG. 1. Thus, even after a liquid packing material is filled in the interior of the bag body portion under gas-less condition, the standing posture can be maintained at a flat form in its upper part and at a cylindrical form in its lower part by the sealing applied to the left and right side edges, so that the flattening property (flatness) of the two front and rear laminate plastic films constituting the flat film valve is high and the self-sealing one-way function can be developed effectively.

In the self-standing liquid package bag A having such a construction according to the invention, the filling of the liquid packing material into the bag under degassing condition through liquid-in-seal filling so as not to retain gas therein is required for developing the self-sealing one-way function of the flat film valve 1.

In the flat film valve 1, it is preferable to form a tear-inducing flaw 1*a* made from an opening means such as I-notch, V-notch, U-notch, base notch, diamond cut or the like in a predetermined tear-opening position (pouring port) of an upper edge part of the valve as shown in FIG. 1. The valve is ready for use by opening the tear-inducing flaw 1*a*.

Also, it is preferable to dispose a steepled protrusion 1*b* for prevention of liquid dripping at a position somewhat shifted from the predetermined opening portion toward a base end side in the lower edge part of the flat film valve 1. This protrusion 1*b* is formed for preventing the liquid dripping caused in the opening end of the flat film valve 1 from falling down along the bag body portion 2 from the lower end of the flat film valve 1.

Moreover, it is preferable that the flat film valve 1 is formed by superposing flat sheets as long as possible for imparting an excellent one-way function.

Figure 4:
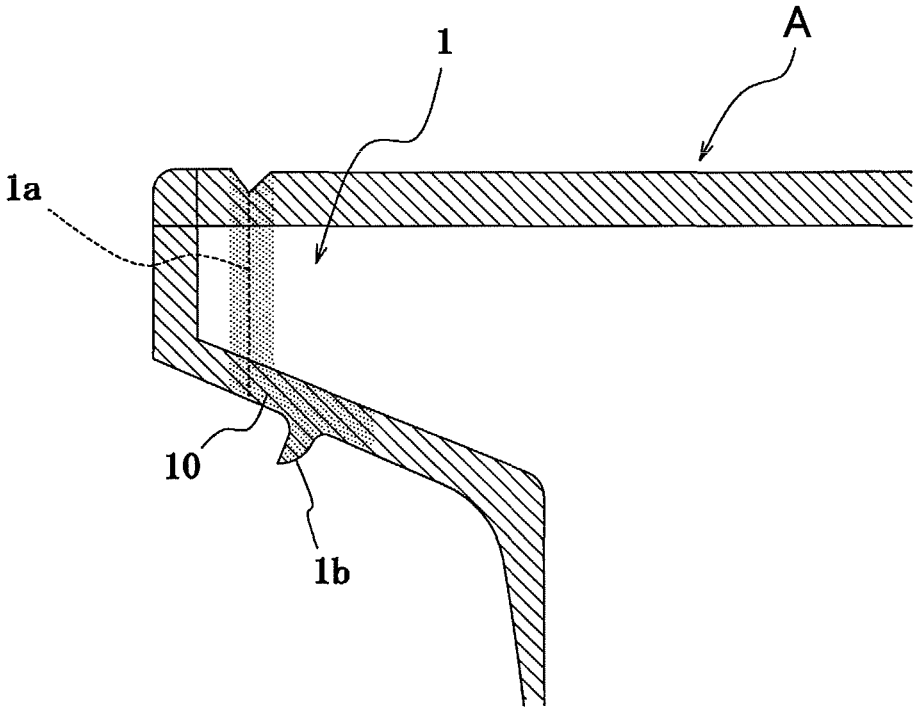
FIG. 4 is a view illustrating a state of disposing a water-repellant layer on the self-standing liquid package bag according to the invention.

Onto an outer surface of the flat film valve 1, i.e. an outer surface of the base film layer 5, 5' (50, 50') ranging from the predetermined tear line (predetermined opening line) toward the base end side thereof is preferably formed a coating layer of a water-repelling agent or oil-repelling agent (water-repellant/oil-repellant coating layer) 10 for preventing liquid dripping and improving liquid cutting at least along the opening end and the lower end part as shown by dotted area in FIG. 4.

In this connection, it is preferable to form the coating layer 10 of the water-repelling agent or oil-repelling agent on the steepled protrusion 1*b* for prevention of liquid dripping, whereby the liquid cutting property can be further improved.

In order to use the liquid package bag according to the invention itself alone by bringing about the self-standing property, at least one of the laminate plastic films constituting the liquid package bag is preferable to be made from a chewy laminate plastic film thicker than the conventional non-self standing liquid package bag. In this case, there is a fear that the closing between the inner faces in the pouring path of the flat film valve 1 or the shrink or collapse deformation of the bag body portion 2 is obstructed to deteriorate the one-way function. In the invention, therefore, as shown in FIGS. 2 and 3, a wet-treated layer 11 for assisting the one-way function is preferably formed on the surface of the inner sealant layer 6, 6' (or 60, 60'), particularly inner faces of portions forming a pouring path 8.

Figure 5:
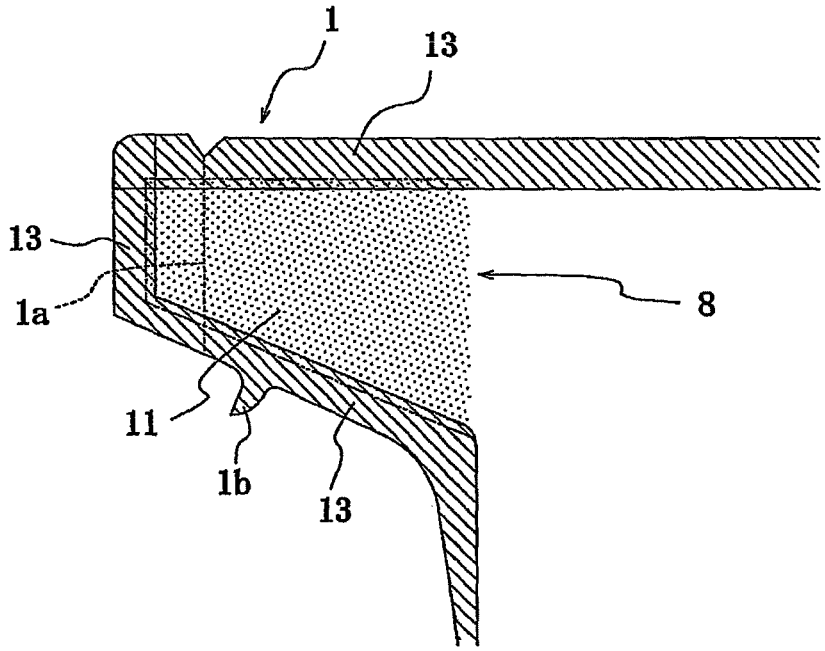
FIG. 5 is a view illustrating a state of conducting a wetting treatment in the self-standing liquid package bag according to the invention.

In the self-standing liquid package bag A of the invention, it is preferable to dispose a wet-treated layer 11 not only on the inner face of the pouring path 8 of the flat film valve 1 but also on the boundary portion between the pouring path 8 and the outer peripheral fused part 13 of the flat film valve 1 as exemplified by a dotted area in FIG. 5. Since the boundary portion is particularly a portion having a weak closing force through intermolecular force of the liquid packed material interposed between the laminate plastic films 3, 4 or a portion easily obstructing the aforementioned one-way function, the arrangement of the wet-treated layer 11 on this portion is effective to enhance the one-way function of the flat film valve 1 and prevent reverse flowing of air.

In the self-standing liquid package bag A of the invention, as shown in FIG. 1, the protrusion 9 (formed by a seal) as a damming portion for rectifying the poured flow may be disposed on the upper edge sealed portion in the pouring path 8 of the flat film valve 1 so as to attain constant volume pouring. Moreover, the protrusion 9 is preferable to be formed curvedly. Not only the excessive pouring can be prevented by the damming effect of the protrusion 9, but also there is no fear of peeling the seal due to the concentration of the pouring flow of the liquid packed material into the protrusion 9, so that it is possible to pour the constant volume stably.

The pouring of the liquid packed material from the self-standing liquid package bag A can be carried out by tearing the tear-inducing flaw 1*a* of the flat film valve 1 to open the flat film valve 1 or ensure the pouring port thereof and then tilting the self-standing liquid package bag A at such a state without penetrating and sucking ambient air form the pouring port. On the other hand, the inner faces of the flat film valve 1 are fully closed to each other under the presence of a liquid film made from the liquid packed material wetting the inner faces associated with the stop of pouring based on the returning of the self-standing liquid package bag A to a standing posture, whereby the penetration of ambient air into the self-standing liquid package bag A can be prevented surely.

Thus, the liquid packed material gas-less filled in the self-standing package bag A through liquid-in-seal filling is poured under a shrink or collapse deformation corresponding to the poured volume of the liquid packed material without causing the penetration of ambient air into the self-standing liquid package bag A.

After the pouring of the liquid packed material is stopped, the inner faces of the pouring path of the flat film valve 1 are close-sealed by the one-way function to prevent the penetration of ambient air into the self-standing liquid package bag A, whereby the pollution, oxidation and the like of the liquid packed material remaining in the self-standing liquid package bag A through ambient air can be prevented sufficiently.

Thus, the pouring port formed in the top part of the flat film valve 1 is automatically close-sealed after the required amount of the liquid packed material is poured, so that the self-standing liquid package bag A is returned to the standing posture under such a state.

As previously mentioned, the close-sealing of the flat film valve 1 for the one-way function is carried out by releasing the flat film valve 1 from hydraulic head pressure to return the front and rear laminate plastic films 3, 4 (30, 40) to original form in the time of producing the flat film valve 1 and by leaving the front and rear laminate plastic films 3, 4 (30, 40) in an atmosphere under a reduced pressure when the liquid packed material in the flat film valve 1 is back-flown to the bag body portion 2 to thereby stick the inner faces (sealant layers 6, 6' (60, 60')) of the soft laminate plastic films 3, 4 (30, 40) to each other under the presence of the liquid packed material adhered to these inner faces by a negative pressure through capillary action of the liquid packed material over a full width of the flat film valve 1, and so on.

The close-sealing of the films based on such a self-sealing one-way function is more surely maintained when the interior of the bag body portion 2 is made to a reduced pressure based on the elastic restoring force inherent to the bag body portion 2 collapse-deformed or the like.

In the self-standing liquid package bag A of this embodiment, as shown in FIG. 1, the bottom part is preferable to be shaped into a downwardly convex and gentle curved form by chamfering both corner parts of the ship's bottom portion. In this case, the corners of the bottom part are not hit against a floor face in the grounding and the lower end portion of the self-standing liquid package bag A is wholly contacted with the floor face, whereby the self-standing posture can be ensured stably.

Moreover, both corner parts of the ship's bottom portion in the self-standing liquid package bag A are preferable to be chamfered so as to have a radius of curvature R of not less than 8 mm, more preferably 8 mm to 20 mm. Particularly, the radius of curvature R is preferable to be shaped so as to gradually reduce toward the bottom of the standing pouch A. Moreover, the reason why the radius of curvature R is limited to not less than 8 mm is due to the fact that when it is less than 8 mm, both corner parts of the ship's bottom portion are hit against the floor face to float the central portion of the standing pouch A upward.

The technique of the invention is utilizable as a usual package body filling a liquid material, particularly a refill package bag provided with a liquid pouring port integrally united to a bag body portion.

The invention claimed is:

1. A self-standing liquid package bag comprising:

two front and rear laminate plastic films integrally defining a bag body portion and a flat film valve portion, each film including an oriented base film layer and a sealant layer laminated on at least one surface of the base film layer;

the flat film valve protruding from an upper part of a side edge of the bag body portion, the flat film valve having a fusion portion and a non-fusion portion such that the flat film valve retains a self-sealing one-way function, the fusion portion being opposed inner sealant layers of the front and rear laminate plastic films fused to one another at peripheral parts of the flat film valve other than base end sides thereof, the non-fusion portion being a pouring path for a liquid;

a wet-treated layer provided on the pouring path of the flat film valve and a part of the fusion portion adjacent to the pouring path; and a self-standing bottom portion is provided at a bottom of the bag body portion, wherein wherein the front laminate plastic film is a high-nerve film having a nerve of not less than 40 mN but not more than 600 mN, the rear laminate plastic film is a low-nerve film having a nerve of not less than 10 mN but less than 40 mN, and when liquid is poured by a tilting of the bag body portion, a negative pressure is generated inside the bag body portion such that inner surfaces of the laminate plastic films closely adhere to each other in a wetted state to retain the liquid in the pouring path and to simultaneously prevent ambient air from entering the bag body portion.

2. The self-standing liquid package bag according to claim 1, wherein the bag body portion is a three-side sealed self-standing bag other than the self-standing bottom portion made of a soft laminate plastic film, and a standing posture of the bag body portion is flat in an upper part thereof and cylindrical in a lower part thereof.

3. The self-standing liquid package bag according to claim 1, wherein the flat film valve is provided with a coating layer of a liquid-repellant material in a region including a predetermined opening position disposed in at least a tip part of an outer surface of the flat film valve.

4. The self-standing liquid package bag according to claim 1, wherein the flat film valve is provided with a steepled protrusion for prevention of liquid dripping at a lower end part located from a predetermined opening portion toward the base end side of the flat film valve.

5. The self-standing liquid package bag according to claim 1, wherein the wet-treated layer of the pouring path in the flat film valve is provided on the high-nerve film.

6. The self-standing liquid package bag according to claim 1, wherein the wet-treated layer of the pouring path in-the flat film valve is provided on the low-nerve film.

* * * * *